United States Patent [19]

Knox, Sr.

[11] 4,094,932

[45] June 13, 1978

[54] CARBURETOR CHECKING AND ADJUSTING APPARATUS

[76] Inventor: Kenneth L. Knox, Sr., 1796 Hillboro Ave., Reno, Nev. 89502

[21] Appl. No.: 749,079

[22] Filed: Dec. 9, 1976

[51] Int. Cl.[2] ..... F02M 3/08

[52] U.S. Cl. ..... 261/41 D; 261/71; 261/DIG. 38

[58] Field of Search ..... 261/DIG. 38, 41 D, 71

[56] References Cited

U.S. PATENT DOCUMENTS 3,313,532 4/1967 Carlson et al. ..... 261/DIG. 38

FOREIGN PATENT DOCUMENTS 2,434,891 10/1975 Germany ..... 261/DIG. 38

*Primary Examiner*—Tim R. Miles

*Attorney, Agent, or Firm*—Blair, Brown & Kreten

[57] ABSTRACT

A checking and adjusting apparatus for the carburetor of an internal combustion engine such as an automobile or other vehicle, and wherein there is provided a warning signal on the dashboard of the vehicle that will be actuated when the carburetor is out of adjustment. In addition there is provided a hand controlled device for adjusting the carburetor from the dashboard of the vehicle.

3 Claims, 6 Drawing Figures

MICRO SWITCH
TO SPARK ADVANCE CONTROL

FIG. 3.
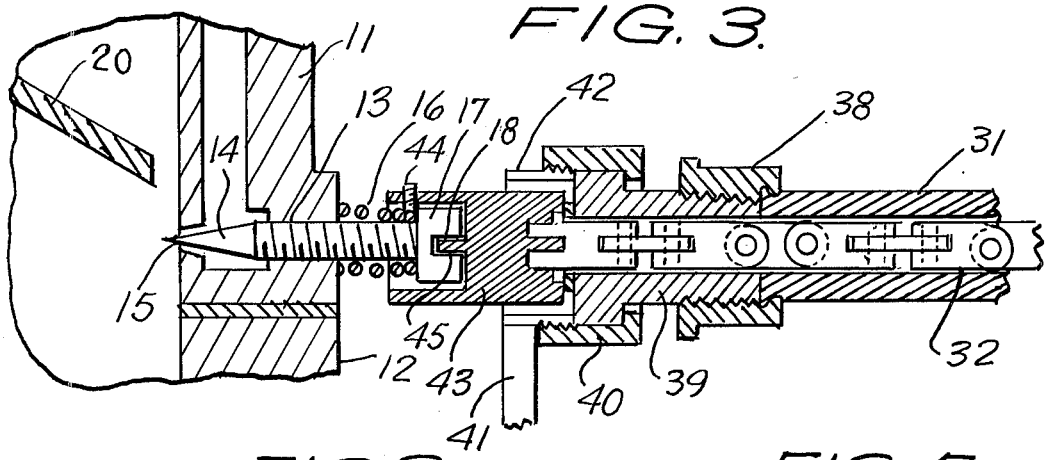
FIG. 6.
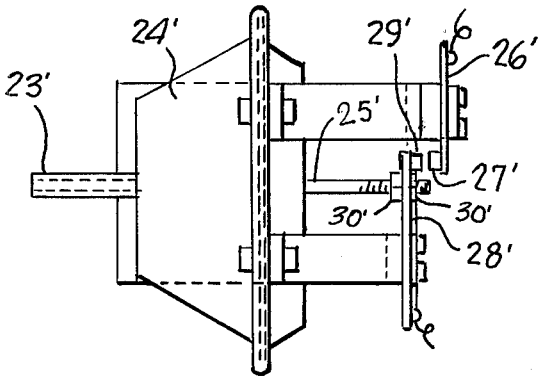
FIG. 5.
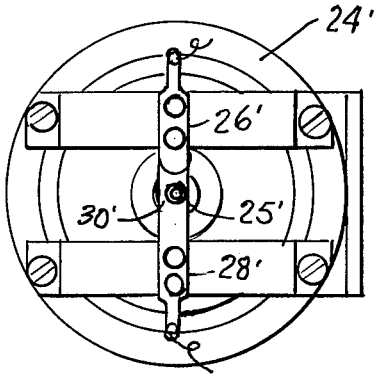
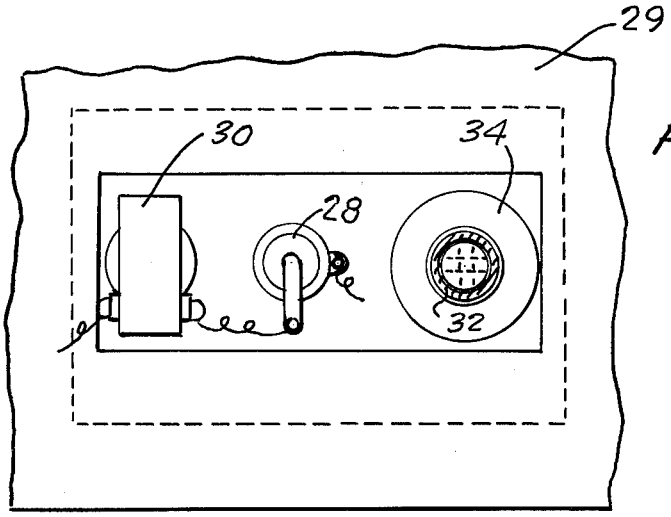
FIG. 4.

CARBURETOR CHECKING AND ADJUSTING APPARATUS

BACKGROUND OF THE INVENTION

FIELD OF THE INVENTION

The present invention relates to carburetor checking and adjusting apparatus for internal combustion engines.

SUMMARY OF THE INVENTION

A checking and adjusting apparatus for a carburetor that will indicate to the operator of the vehicle when the carburetor is out of adjustment sufficiently to cause a reduction of vacuum in a carburetor. In addition there is provided a means under the control of the operator to make adjustments to the carburetor from the interior of the vehicle.

The primary object of the present invention is to provide a carburetor checking and adjusting device that will notify the vehicle operator when the carburetor requires adjustment and permit the adjustment required to be made.

Still another object of the present invention is to provide a carburetor checking and adjustment device that is rugged in structure, efficient in use and which is relatively simple and inexpensive to manufacture and install.

Other objects and advantages will become apparent in the following specification when considered in light of the attached drawings.

BRIEF DESCRIPTION OF THE DRAWINGS

FIG. 3 is an enlarged fragmentary sectional view taken on the line 3—3 of FIG. 1 looking in the direction of the arrows;

FIG. 4 is an enlarged fragmentary transverse sectional view taken on the line 4—4 of FIG. 1 looking in the direction of the arrows;

FIG. 5 is a front elevation of a modified form of the invention; and

FIG. 6 is a side elevation of the structure shown in FIG. 5.

DESCRIPTION OF THE PREFERRED EMBODIMENTS

Figures 1, 2:
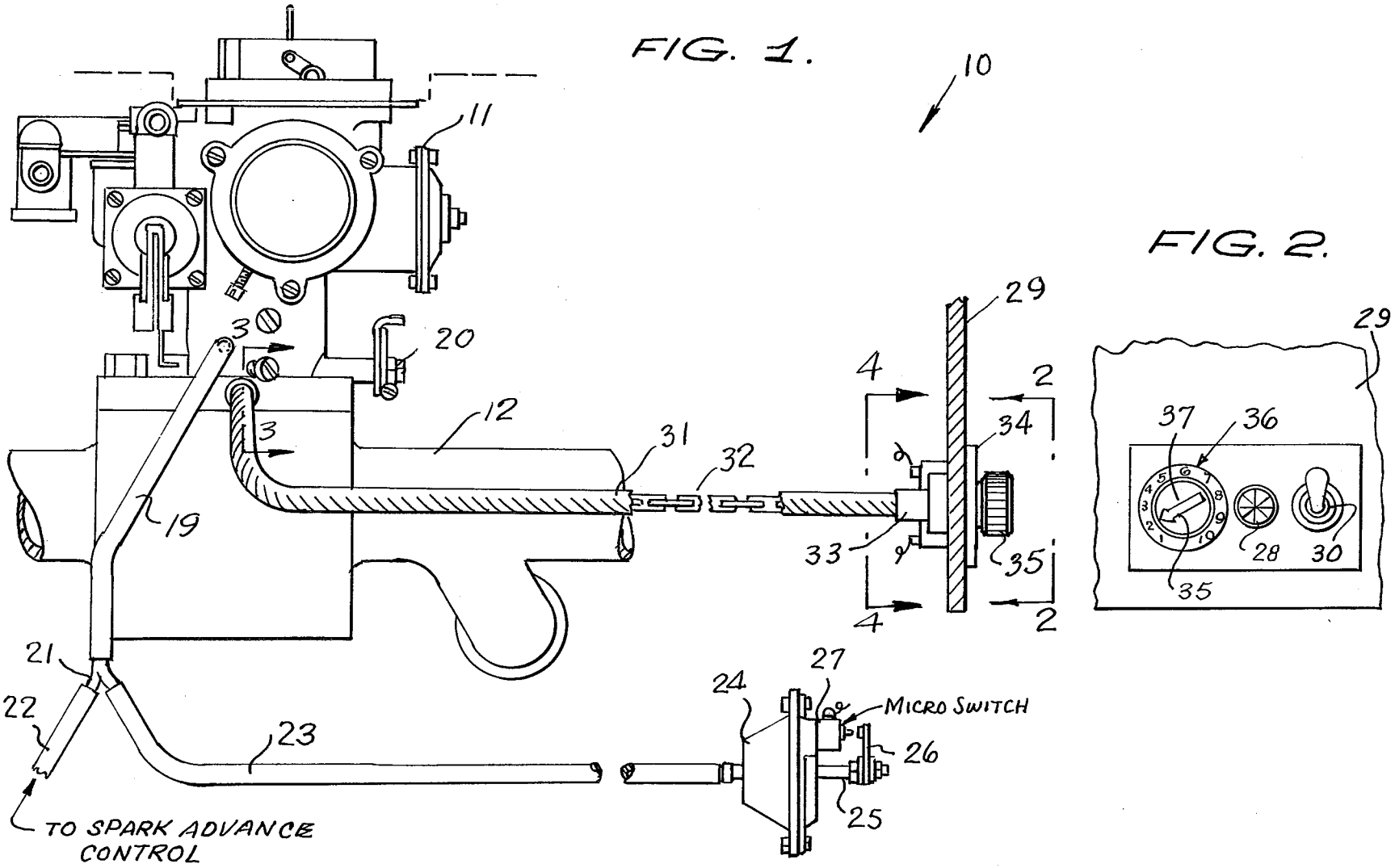
FIG. 1 is an elevational view with parts broken away and in section illustrating a conventional carburetor with the invention connected thereto.
FIG. 2 is a fragmentary elevational view showing a portion of the vehicle dashboard and showing the adjustment knobs thereon, as viewed from the line 2—2 of FIG. 1 looking in the direction of the arrows.

Referring now to the drawings in detail, wherein like reference characters indicate like parts throughout the several figures, the reference numeral 10 indicates generally a carburetor checking and adjusting device constructed in accordance with the invention.

The device 10 is adapted for use with a carburetor 11 connected to and operatively associated with an intake manifold 12 of an internal combustion engine. The carburetor 11 has a conventional mixture control screw 13 threaded into the side of the carburetor 11 and is preferably for idling and having a tapered end 14 cooperating with a tapered sit 15 to control air passing through the carburetor 11. A compression coil spring 16 is engaged between the head 17 of the screw 13 and the base of the carburetor 11 to assist in preventing the screw 13 from moving from its adjusted position. The head 17 of the screw 13 has a transverse screw driver slot 18 formed therein.

The carburetor 11 and the adjustment screw 13 associated therewith is of conventional construction and is described in detail to illustrate how the invention is utilized with respect thereto.

The carburetor 11 has a conventional vacuum line 19 connected to the throat thereof downstream from but closely adjacent to the throttle valve 20 and closely adjacent to the intake manifold 12. The vacuum line 19 normally provides vacuum to the spark advance control of the engine to which the carburetor 11 is attached. A Y-fitting 21 is connected to the vacuum line 19 with one leg connected to the spark advance control conduit 22 and the opposite line connected to a vacuum conduit 23.

The vacuum line 23 is connected to a vacuum operated diaphragm 24 having an operating shaft 25 extending outwardly therefrom. An arm 26 is adjustably connected to the shaft 25 and is positioned to actuate a micro switch 27 mounted on the diaphragm 24. The micro switch 27 is normally closed and is opened when vacuum in the vacuum conduit 23 pulls the shaft 25 inwardly so as to cause the arm 26 to contact the micro switch 27.

The micro switch 27 is wired to indicator lamp 28 on the dashboard 29 of a vehicle through a hand controlled toggle switch 30. When the engine is in operation and vacuum is present in the throat of the carburetor 11 the micro switch is actuated by the arm 26 to open the contacts thereof so that the indicator lamp 28 does not burn. When the vacuum in the carburetor 11 falls the diaphragm 24 is released and the shaft 25 moves outwardly disengaging the arm 26 from the micro switch 27 to permit the contacts of the micro switch 27 to close and light the indicator lamp 28 when the toggle switch 30 is closed. This indicates to the driver a loss of vacuum and a need to adjust the carburetor so as to restore the correct ratio of fuel to air which will reestablish the vacuum in the carburetor 11.

A flexible cable 31 having a drive chain 32 therein extends from the dashboard 29 to the carburetor 11. An end 33 on the flexible cable 31 is secured to a fitting 34 mounted on the dashboard 29 and the drive chain 32 is connected to a knob 35 to be turned thereby. The fitting 34 is provided with a plurality of indicating numbers shown generally by the reference numeral 36 and the knob 35 has an arrow 37 thereon to permit the knob 35 to be rotated to an exact position as desired.

The opposite end 38 of the flexible cable 31 is connected to a fitting 39 having a nut 40 mounted thereon. A bracket 41 has a circular fitting 42 positioned thereon to receive the nut 40 to secure the cable 31 to the fitting 41. The fitting 41 is secured by any suitable means to the intake manifold 12 to support the cable 31 in axially aligned relation to the screw 13.

A coupler 43 is secured to the chain 32 and encompasses the head 17 of the screw 13 to which it is secured by a set screw 44. The coupler 43 has a blade 45 formed thereon to engage in the slot 18 of the screw 13 so as to rotate the screw 13 when the chain 32 is rotated by the knob 35.

A slightly modified form of the invention is illustrated in FIGS. 5 and 6 as a substitute for the diaphragm operated micro switch of the preferred form of the invention. In FIGS. 5 and 6 a vacuum conduit 23′ extends to a diaphragm actuator 24′ having a threaded shaft 25′ extending therefrom and adapted to reciprocate under the influence of the diaphragm actuator 24′ as a vacuum varies in the vacuum conduit 23′. A fixed electrical contact arm 26′ is secured to the vacuum actuator 24′ and has an electric contact 27′ mounted thereon. A resilient contact arm 28′ is secured to the vacuum actuator 24′ and has an electric contact 29′ mounted thereon opposed to the electric contact 27′ and adapted to cooperate therewith to complete an electric circuit. The resilient arm 28′ is secured to the threaded shaft 25′ by a pair of nuts 30′ so as to be adjustable on the shaft 25′.

The apparatus illustrated in FIGS. 5 and 6 normally has the contacts 27′, 29′ in engagement completing a circuit to the indicator bulb 28. Vacuum in the carburetor throat reaches the vacuum actuator 24′ through the vacuum conduit 23′ to move the shaft 25′ breaking the engagement between the contacts 27′, 29′ to extinguish the light in the bulb 28 when the carburetor 11 is operating so as to have correct vacuum level therein.

In some instances for example while idling the vacuum level in the carburetor will be enough to light the bulb 28 even when adjustments to the carburetor are not needed. When these conditions exist the toggle switch 30 is opened to prevent the indicator bulb 28 from lighting.

Having thus described the preferred embodiments of the invention it should be understood that numerous structural modifications and adaptations may be resorted to without departing from the spirit of the invention.

What is claimed is:

1. In a motor vehicle of the type having an instrument panel dashboard, an engine including, an intake manifold, a carburetor mounted on the intake manifold with the carburetor having a throttle valve controlled throat immediately adjacent the intake manifold and an idle mixture control screw having a transverse slot, said screw being adjacent the intake manifold in combination with a carburetor checking and adjusting apparatus comprising a vacuum conduit extending from the carburetor, a vacuum actuated normally closed electric switch connected to said vacuum conduit and responsive to the vacuum in the carburetor to open said electric switch, an indicator bulb mounted on said dashboard, a hand controlled electric switch on said dashboard, electric wiring connecting said electric switch, said hand controlled electric switch and said bulb to energize said bulb when said switches are both closed, a flexible cable connected on one end to said idle mixture control screw wherein said cable and said screw are interconnected by coupling means having a first blade which engages said slot of said control screw at one extremity and a second blade which engages a slot associated with said flexible cable remote from said first blade for transmitting rotation therethrough, and bracket means overlying said cable fastening said cable to a portion of the engine to maintain alignment between said cable and said screw, and a hand controlled knob on said dashboard connected to the opposite end of said cable to rotate said mixture control screw on rotation of said knob to control the mixture in said carburetor and thus varying the vacuum in said carburetor.

2. A device as claimed in claim 1 including an indicia plate on said dashboard cooperating with said knob for indicating the rotational position of said knob.

3. A device as claimed in claim 1 wherein said flexible cable includes a flexible chain drive member.

* * * * *